US009320335B2

(12) United States Patent
Grez et al.

(10) Patent No.: US 9,320,335 B2
(45) Date of Patent: Apr. 26, 2016

(54) GROOMING DEVICES AND METHODS THEREFOR

(71) Applicant: L'Oreal, Paris (FR)

(72) Inventors: Joseph W. Grez, North Bend, WA (US); Gerald K. Brewer, Redmond, WA (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 14/144,306

(22) Filed: Dec. 30, 2013

(65) Prior Publication Data

US 2015/0182000 A1 Jul. 2, 2015

(51) Int. Cl.

| | |
|---|---|
| ***A46B 13/00*** | (2006.01) |
| ***A45D 27/00*** | (2006.01) |
| ***A46B 13/02*** | (2006.01) |

(52) U.S. Cl.

CPC ..... *A45D 27/003* (2013.01); *A46B 13/008* (2013.01); *A46B 13/02* (2013.01)

(58) Field of Classification Search

CPC ..... A45D 27/003; A45D 2027/006; A45D 2200/1009; A45D 2200/1054; A45D 24/007; A61H 7/003; A61H 7/004; A61H 7/005; A61H 2205/022; B26B 19/3806; B26B 19/3813; B26B 29/00; B26B 29/06; A61B 2017/320004; A61B 2017/320008; A61B 2017/320012; B25F 3/00; A46B 2200/104; A46B 2200/10; A46B 2200/1006; A46B 2200/1093; A46B 2200/3093; A46B 13/00; A46B 13/001; A46B 13/003; A46B 13/008; A46B 13/02; A46B 13/023; A46B 13/026; A46B 17/04; A46B 7/08

USPC ..... 132/119.1, 120, 124, 143, 313, 333, 132/76.4, 271; 606/133; 15/28, 21.1, 23, 15/34, 104.15, 104.16, 229.11; 30/29.5, 30/30, 31; 119/609, 612, 615, 618, 620, 119/664

See application file for complete search history.

(56) References Cited

U.S. PATENT DOCUMENTS

| | | | | | |
|---|---|---|---|---|---|
| 227,857 | A | * | 5/1880 | Stow | 15/28 |
| 817,111 | A | * | 4/1906 | Hale | 15/28 |
| 1,193,287 | A | * | 8/1916 | Morgan | 15/188 |
| D57,628 | S | | 4/1921 | Finney | |
| 2,040,599 | A | * | 5/1936 | Davies | 451/523 |
| 2,714,788 | A | * | 8/1955 | Di Giovanna | 451/359 |
| 2,753,583 | A | * | 7/1956 | Jepson | 15/246 |
| 2,812,530 | A | | 11/1957 | Whitesel | |
| 2,835,084 | A | * | 5/1958 | Fotre | 451/344 |
| 4,919,117 | A | * | 4/1990 | Muchisky et al. | 601/114 |

(Continued)

FOREIGN PATENT DOCUMENTS

| | | | |
|---|---|---|---|
| EP | 0986656 | B1 | 11/2004 |
| EP | 1612007 | A1 | 1/2006 |
| WO | 2009097600 | A1 | 8/2009 |

*Primary Examiner* — Todd E Manahan
*Assistant Examiner* — Brianne Kalach
(74) *Attorney, Agent, or Firm* — Christensen O'Connor Johnson Kindness PLLC

(57) ABSTRACT

Devices and/or methods for treating facial hair are provided in order to soften the feel thereof. The devices and/or methods generally alter the structure of the tips or ends of the hair follicles to enhance their feeling of softness. Some devices and methods employ a high speed impacting principle to split the ends of the hair follicles. Some devices and methods aim to reduce the thickness of hairs near the tips through abrasion. Some devices and/or methods employ both crushing/impacting and abrasion in order to soften the feel of a subject's facial hair.

14 Claims, 5 Drawing Sheets

(56) References Cited

U.S. PATENT DOCUMENTS

| | | | | |
|---|---|---|---|---|
| 5,279,080 | A * | 1/1994 | Muller et al. | 451/525 |
| 5,377,699 | A * | 1/1995 | Varnum | 132/76.4 |
| 5,406,669 | A * | 4/1995 | Lesiw | 15/179 |
| 5,799,666 | A * | 9/1998 | Wu | 132/76.4 |
| D408,586 | S | 4/1999 | Nielsen | |
| 5,937,526 | A | 8/1999 | Wahl | |
| 6,471,712 | B2 * | 10/2002 | Burres | 606/131 |
| 7,267,125 | B2 * | 9/2007 | Nevakshonoff | 132/73.6 |
| 7,270,641 | B2 * | 9/2007 | Glucksman et al. | 601/112 |
| 7,665,422 | B2 * | 2/2010 | Kissel, Jr. | 119/609 |
| 7,752,702 | B2 | 7/2010 | Nakamura | |
| 8,966,710 | B1 * | 3/2015 | Lozano | 15/400 |
| 2003/0125754 | A1 * | 7/2003 | Davis et al. | 606/133 |
| 2003/0131865 | A1 * | 7/2003 | Richmond et al. | 132/119.1 |
| 2003/0192564 | A1 * | 10/2003 | Johnson | 132/119.1 |
| 2004/0073274 | A1 * | 4/2004 | Cook et al. | 607/50 |
| 2004/0167544 | A1 * | 8/2004 | Nicolosi | 606/133 |
| 2004/0204721 | A1 * | 10/2004 | Lee | 606/133 |
| 2006/0130335 | A1 * | 6/2006 | Suen | 30/34.05 |
| 2008/0230246 | A1 * | 9/2008 | Dollar-Wright | 173/29 |
| 2009/0241975 | A1 * | 10/2009 | Nakakura | 132/120 |
| 2010/0024139 | A1 * | 2/2010 | Linsbichler et al. | 15/31 |
| 2010/0217263 | A1 * | 8/2010 | Tukulj-Popovic | 606/43 |
| 2010/0242201 | A1 | 9/2010 | Linzell | |
| 2010/0331861 | A1 * | 12/2010 | Muraki et al. | 606/133 |
| 2011/0185528 | A1 | 8/2011 | Befve | |
| 2012/0041452 | A1 * | 2/2012 | Grieshaber et al. | 606/133 |
| 2012/0111350 | A1 | 5/2012 | Finfrock | |
| 2013/0023901 | A1 * | 1/2013 | Sanchez-Martinez et al. | 606/133 |
| 2013/0060176 | A1 * | 3/2013 | Nichols | 601/137 |
| 2014/0047650 | A1 * | 2/2014 | Hsieh | 15/28 |
| 2014/0090607 | A1 * | 4/2014 | Dole et al. | 119/609 |
| 2014/0283864 | A1 * | 9/2014 | Finfrock | 132/200 |
| 2014/0305458 | A1 * | 10/2014 | Brewer et al. | 132/200 |

* cited by examiner

GROOMING DEVICES AND METHODS THEREFOR

BACKGROUND

Grooming practices vary among individuals, but generally include shaving or trimming beards, combing, brushing, and styling head hair, etc. Grooming devices for carrying out these practices include razors, scissors, trimmers, combs, brushes, etc.

A beard is the collection of hair that grows on the chin, upper lip, cheeks, and necks of human beings. Conventional grooming practices relating to beards include shaving and trimming. Some conventional grooming practices include both shaving and trimming in order to leave mustaches or goatees of varying shapes and sizes.

Beard hairs up to two (2) cm or so tend to be thick and stiff. Beards composed of hairs of these lengths are scratchy and harsh to the touch but are the most popular type. To address the bristly nature of these hairs, a chemical product was marketed in the last century that claimed to soften the beard. However, this chemical product only conditioned the hairs, reducing surface friction of the hair, but did not alter the structure of the hair follicles to soften the beard. It is believe that no device has been created that has the potential for softening the feel of beard hairs.

The grooming industry is therefore looking for devices and/or methods for softening the feel of facial hair, such as beards.

SUMMARY

To address these needs and others, the present disclosure sets forth examples of devices and methods directed to grooming practices that alter the structure of the beard hair, thereby resulting in softening the feeling of the beard to the touch. As will be described in more detail below, the various devices and methods employ various techniques to either split or taper the ends of the hair follicles. Both methods have been shown to create beards that are noticeably softer and more attractive to touch compared to a non-treated beard. Several examples of the devices and methods described herein combine these techniques to arrive at softer feeling facial hair. It should be appreciated that the grooming devices and methods disclosed herein have wide application, and that hair of the body other than beards may benefit from one or more aspects of the disclosed subject matter.

In accordance with aspects of the present disclosure, a personal grooming device is provided. The device includes an appliance including a rotary drive system, and at least one hair softening head coupled to the appliance so as to be rotated by the rotary drive system. In some embodiments, the hair softening head includes one of an abrasive pad or a plurality of spaced apart, bristle groups configured to groom the tips of a subject's hair follicles when rotationally applied to the subject's hair.

In accordance with another aspect of the present disclosure, a grooming device is provided. The device includes first and second parallely oriented, counter-rotating treatment heads, wherein the tops of the treatment heads are substantially co-planer. The device also includes a drive system coupled to the first and second rotary heads. The drive system in some embodiments is configured to impart counter-rotational movement to the first and second heads. In some embodiments, the heads are configured to groom the tips of a subject's hair follicles when rotationally applied to the subject's hair.

In accordance with another aspect of the present disclosure, a method is provided for softening a subject's hair with a personal grooming device. In some embodiments, the device includes a rotary drive system and at least one hair softening head coupled thereto so as to be rotated by the rotary drive system. The at least one hair softening head in some embodiments includes at least one contact surface. The method comprises rotating the at least one hair softening head and applying the at least one rotating hair softening head against the facial hair of the subject in order for the at least one contact surface to impact the facial hair of the subject.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
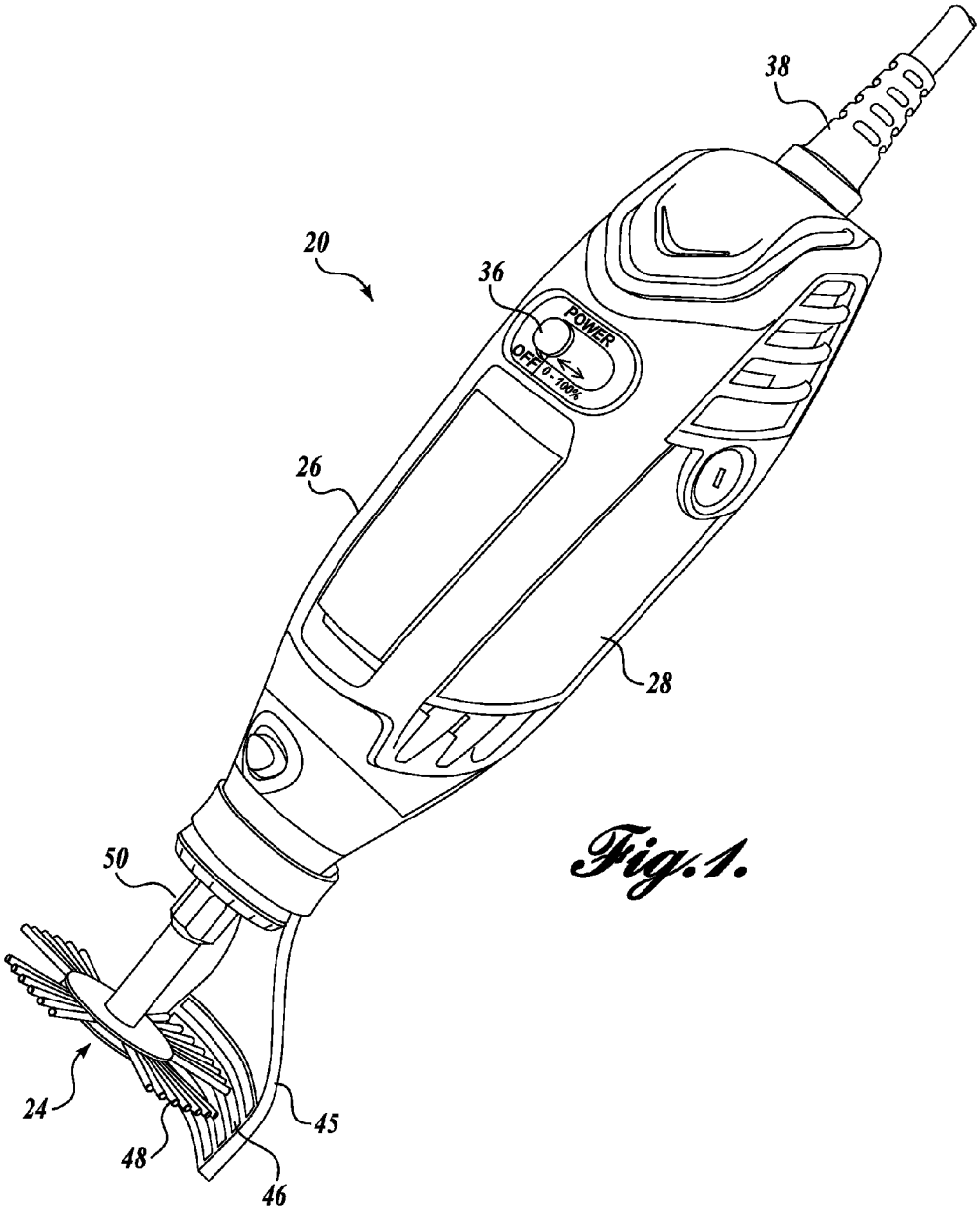
FIG. 1 is a perspective view of one example of grooming device formed in accordance with aspects of the present disclosure.

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples that generally relate to grooming bodily hair of a subject. In particular, the following discussion provides examples of devices and/or methods for treating facial hair, such as beards, goatees, etc., in order to soften the feel thereof. As will be described in more detail below, some examples of the devices and methods of the present disclosure generally alter the structure of the tips or ends of the hair follicles to enhance their feeling of softness, generally by either reducing their stiffness or increasing the area of contact with the skin. Such reduction of stiffness and/or increased area of contact with the skin reduces the concentration of forces the hair tips impart on the skin in contact therewith. As a result, the reduction in the concentration of forces provides for a softer feel to the touch.

In accordance with aspects of the present disclosure, some examples employ a high speed impacting principle to split the ends of the hair follicles, thus increasing the area of contact for each hair and in turn reducing peak contact forces. This results in an enhanced feeling of softness. Splitting the ends of the hair follicles may also result in a reduction in stiffness of the spilt hair follicles, which again can result in an enhanced feeling of softness. In some examples, devices and methods of the present disclosure employ an arrangement that crushes or compresses the hair transversely to create a splitting of the hair follicle. In other examples, devices and methods are provided that employ a high speed contact element, such as the bristles of a rotary brush, to strike and impact the hair follicle. At suitable speeds, the resting inertia of the hair follicle serves to resist the impact of the brush sufficiently to create forces greater than the cohesion of the individual hair's structure. Since hairs are made up of linear fibers encased within a shingled outer sheath, breaking the sheath and separating the axial strands creates a largely axial split in the hair's end. Typically, the end is split into several thin strands.

In accordance with another aspect of the present disclosure, some examples aim to reduce the thickness of hairs near the tips, thus reducing the stiffness of the hairs and lowering peak contact forces. This results in an enhanced feeling of softness. In some examples, the devices and methods of the present disclosure taper the ends of the hair follicle through abrasion.

Some examples of the devices and/or methods described herein employ both crushing/impacting and abrasion in order to soften the feel of a subject's facial hair. Both techniques have been shown to create beards that are noticeably softer and more attractive to touch compared to a non-treated beard. For example, some examples described herein provide one or more hair softening heads suitable for use with a hand-held appliance. In these examples and others, the hand-held appliance rotates the hair softening head such that the hair treatment components of the head rotate at variable speeds between 30 mph (48 kilometers per hour) and 60 mph (97 kilometers per hour) or greater. When the hair softening head is rotated over a subject's beard, the hairs of the beard are split and/or tapered at the ends thereof. In some embodiments, one type of hair softening head is used to split the ends (e.g., approximately 1-4 mm or more from the free end of the hair follicle, etc.) of the individual hairs while a second type of hair softening head is used to taper the ends (e.g., approximately 2-4 mm from the free end of the hair follicle, etc.) of the individual hairs. In this embodiment and others, the hand-held appliance may include a quick change mechanism to quickly and easily swap hair softening heads.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Turning now to FIG. 1, there is shown one example of a personal grooming device, generally designated 20, formed in accordance with aspects of the present disclosure. The device 20 includes a hair softening head 24 rotationally driven by a hand-held appliance, such as rotary tool 26. As will be described in more detail below, the hair softening head 24 includes one or more impact members 48 that can be rotated against a subject's facial hair in order to groom the ends thereof. As will be further described in detail below, the impact of the one or more impact members 48 on each hair follicle aims to "split" the end thereof.

Figure 2:
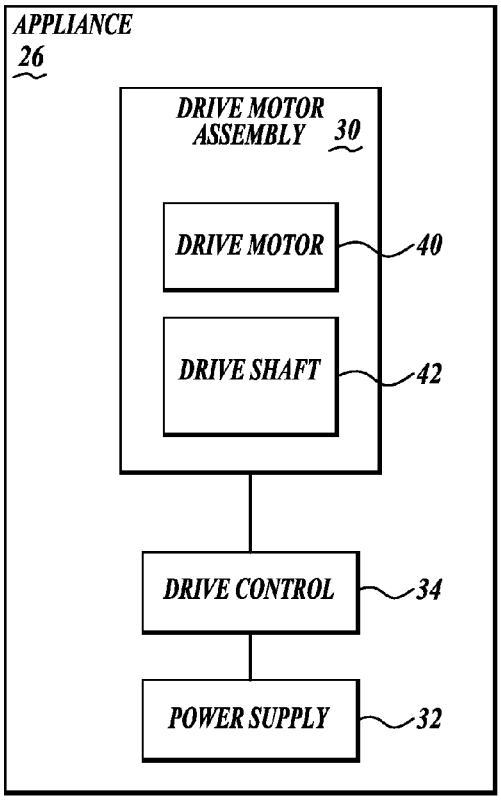
FIG. 2 illustrates in block diagrammatic form one example of a rotary tool associated with the grooming device of FIG. 1.

Turning now to FIGS. 1 and 2, one example of the rotary tool 26 will be described in more detail. As shown in FIG. 1, the rotary tool 26 includes a housing 28 that houses the operating structure of the device. As shown in block diagrammatic form in FIG. 2, the operating structure in one embodiment includes a drive motor assembly 30, a power supply 32, and a drive control 34 that includes a power/speed slider 36 (See FIG. 1) configured and arranged to selectively deliver power from the power supply 32 to the drive motor assembly 30. In some embodiments, the power supply 32 includes a power storage source, such as a rechargeable battery. In other embodiments, a power cord 38 coupled to the power supply supplies power via a "mains" power source.

The drive motor assembly 30 in some embodiments includes an electric drive motor 40 and a rotary drive shaft 42. The power/speed slider 36 of the drive control 34 is coupled to control circuitry, such as a programmed microcontroller or processor, which is configured to control the delivery of power to the drive motor assembly 30 in order to, for example, vary the speed of the drive shaft 42. In some embodiments, the drive motor assembly 30 and the drive control 34 are cooperatively configured to rotate the drive shaft variably between approximately 10,000 rpms and 20,000 rpms or greater.

In the embodiment shown, a tool holder or chuck 50 is coupled to the free end of the drive shaft 42. The chuck 50 may be any mechanism or device that provides tool or toolless, selective, coaxial attachment between the drive shaft 42 and a driven shaft of the hair softening head 24. The rotary tool 26 may include other conventional features. Commercial examples of the rotary tool 26 that may be practiced with some embodiments of the present disclosure include but are not limited to Dremel® branded rotary tools, such as the Dremel®3000.

Figure 3:
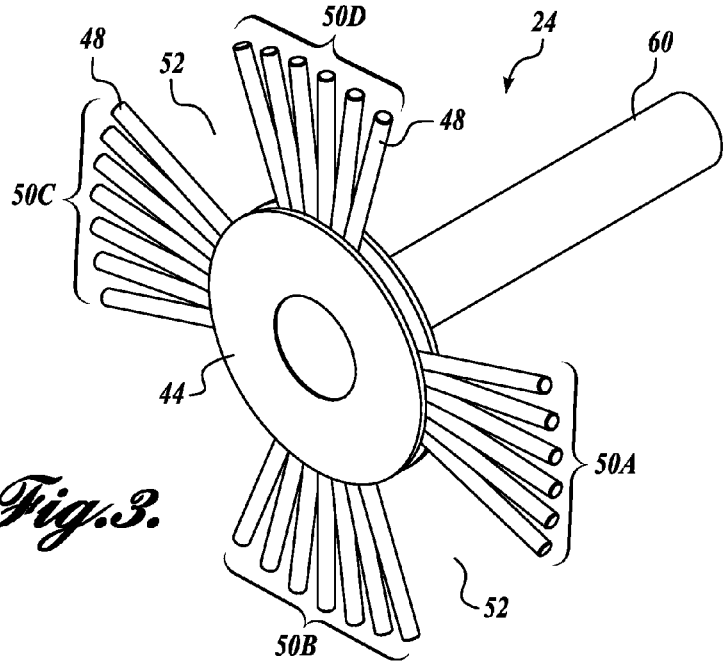
FIG. 3 is a perspective view of one example of a hair softening head in accordance with aspects of the present disclosure.

Turning now to FIGS. 1 and 3, one example of the hair softening head 24 will be described in more detail. As shown in FIG. 3, the head 24 includes a disc-like body 44 from which a plurality of impact members, such as bristles 48, laterally extend. Outwardly extending from the body 44 and generally transverse to the bristles 48 is an attachment interface configured to interface directly or indirectly with the drive shaft 42 of the drive motor assembly 30. In the embodiment shown, the attachment interface includes a centrally located, driven shaft 60 fixedly secured for rotation with the body 44. In this embodiment and others, the driven shaft 60 is configured to be selectively coupled to the drive shaft 42 of the electric motor assembly 30 for co-rotation via the chuck 50. Other couplers for selectively coupling the driven shaft 60 to the drive shaft 42 may be used. Alternatively, in some embodiments, the driven shaft 60 and the drive shaft 42 are integrally formed.

In the embodiment shown in FIG. 3, the bristles 48 are arranged in groups 50A-50D, which are dispersed around the perimeter of the disc-like body 44 so as form gaps or spaces 52 between bristle groups. In use, the gaps or spaces 52 allow for the hair follicles of the subject's beard to enter the rotating bristle field. In some embodiments, the bristles 48 are made of one or more materials including stainless steel, nylon, nylon silicon-carbide, aluminum oxide abrasive grit-coated filaments, etc. In these embodiments and others, the bristles may also include rubberized bristle surfaces. In this regard, it will be appreciated that the rubberized bristle surfaces provide a high coefficient of friction with the hair and can serve to strip away corneocytes of the hair follicles during the hair softening process, thereby reducing thickness and/or allowing splitting of the follicle ends.

In some embodiments, the center of rotation of the head 24 to the tip of bristles 48 is approximately 0.5 inches (12.7 mm). As a result, when the head 24 is rotated by the rotary tool between 10,000 rpms and 20,000 rpms, the tips of bristles 48 travel with speeds in the range of between about 30 mph (48 kilometers per hour) and 60 mph (97 kilometers per hour) or greater, respectively.

The grooming device 20 may also include a guard 45. The guard 45 aims to align the hairs for treatment and to act as a standoff to control the application of the hair softening head 24 to the ends of the hair. In the embodiment shown, the guard 45 includes at least one slot 46. The slot is arranged generally co-planar with the bristles 48 and is sized and configured to allow one or more strands of hair therethrough. The guard 45 can be adjustable so that the length of the hair entering the rotating bristle field is limited in order to prevent inadvertent epilation. In some embodiments, the guard 45 is adjusted so that the facial hairs extend to reach no more than about 0.5 inches (1.26 cm) into the hair softening head 24.

Figure 4:
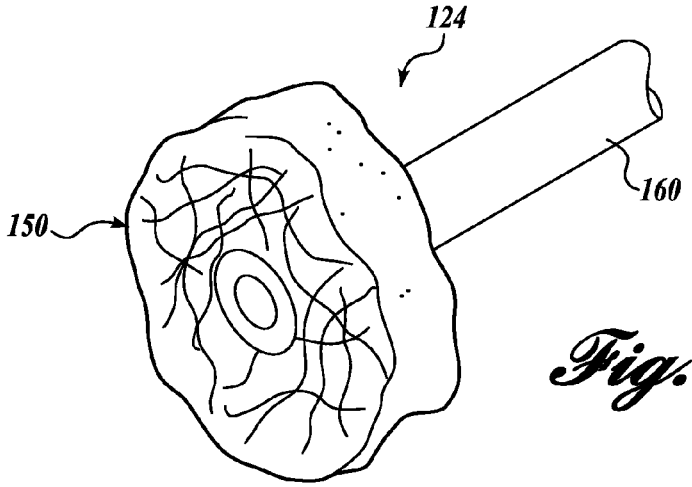
FIG. 4 is a perspective view of another example of a hair softening head in accordance with aspects of the present disclosure.

FIG. 4 illustrates another hair softening head 124 suitable for softening the feel of a subject's facial hair, such as a beard, goatee, etc., when attached to a suitable rotary device, such as the rotary device 26 of FIGS. 1 and 2. As shown in FIG. 4, the head 124 includes a cylinder-like abrasive pad 150. In some embodiments, the material of the abrasive pad 150 includes an aluminum oxide, although other abrasive materials may be used. In the embodiment shown, the head 124 includes an attachment interface in the form of a centrally located, driven shaft 160 fixedly secured for rotation with the body 144. In this embodiment and others, the driven shaft 160 is configured to be selectively coupled to the drive shaft 42 of the rotary tool 26 via chuck 50. In some embodiments, the abrasive pad has a diameter of about one (1) inch (2.54 cm)

The above-described examples of the hair softening heads 24, 124 can be used to soften the hairs of a subject's face. In that regard, either the hair softening head 24 or the hair softening head 124 is attached to the hand-held appliance, such as rotary tool 26. Next, the rotary tool 26 is turned on and the hair softening head 24 or 124 is rotated from about 10,000 rpms to about 20,000 or greater. As a result, the tips of the bristles 48 of head 24 or the edges of abrasion pad 150 of head 124 travel at speeds of between 30 mph (48 kilometers per hour) and 60 mph (97 kilometers per hour) or greater.

Once rotating, the impact surface (e.g., bristles 48 or abrasive pad 150) of the head 24 or head 124 is applied against and traversed over the beard of the subject.

The rotational action of the bristles 48 against the hair follicles of the subject's beard splits the ends thereof. In some embodiments, the impact of the bristles 48 also trims the ends of the hair follicles. In some embodiments, the hair follicles can be trimmed and split by rotation of the head 24 with splits extending 1-4 mm from the trimmed end. Splitting the ends of the hairs of the beard results in a softer feeling beard.

The rotational action of the abrasive pad 150 against the hairs of the subject's beard tapers the ends of the hairs via abrasion. In some embodiments, the hairs can be tapered with the taper extending approximately 2-4 mm from the hair tips. Tapering or thinning the ends of the hairs of the beard results in a softer feeling beard.

Once the areas are softened to the desired amount, the head 24 or 124 can be removed from the beard and the rotary tool 26 can be powered down.

Thus, using examples of the head 24 and/or 124 as described above, in the representative process outlined above, results in a beard with a softer feel. The method described above can be carried-out without an attempt to soften the beard by the use of fluids, formulas, etc. However, any preparation of the beard prior to mechanical softening can be used as part of the method disclosed above. Moreover, methods of the present disclosure include the use of head 24 to split the ends of the hairs and the head 124 to taper the ends of the hairs.

Figure 5:
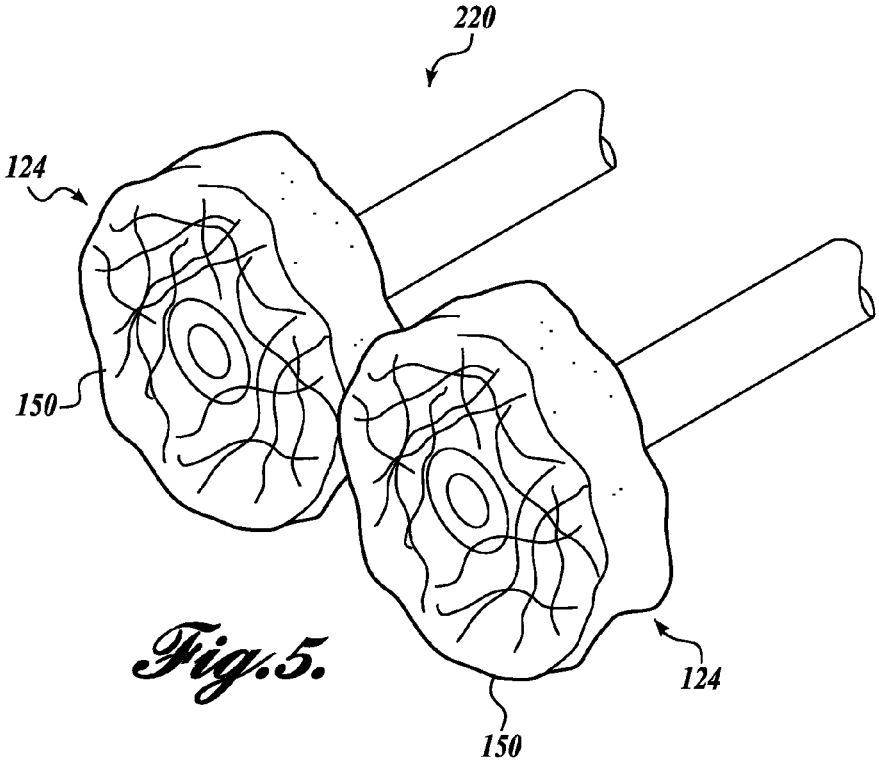
FIG. 5 is a partial perspective view of another example of a grooming device formed in accordance with aspects of the present disclosure.

Turning now to FIG. 5, there is shown a schematic representation of another example of a grooming device, generally designated 220, formed in accordance with aspects of the present disclosure. As shown in FIG. 5, the grooming device 220 grooms the hair follicles transversely between two counter rotating, hair softening heads, such as hair softening heads 124. In the embodiment shown, the hair softening heads 124 are parallely arranged such that the tops of abrasive pads 150 are generally co-planer. The centers of rotation of the abrasion pads 150 are spaced apart so the abrasion pads 150 slightly overlap or pinch together. As a result, when a hair follicle enters the overlapping areas of the counter-rotating heads 150, the hair follicle is abraded, resulting in a thinned or tapered end.

Figure 6:
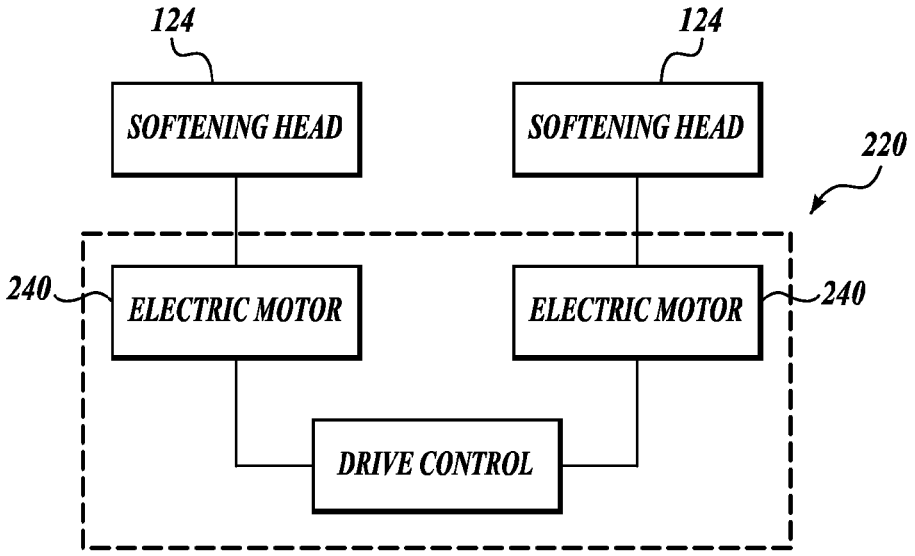
FIG. 6 illustrates in block diagrammatic form one example of the grooming device of FIG. 5.
Figure 7:
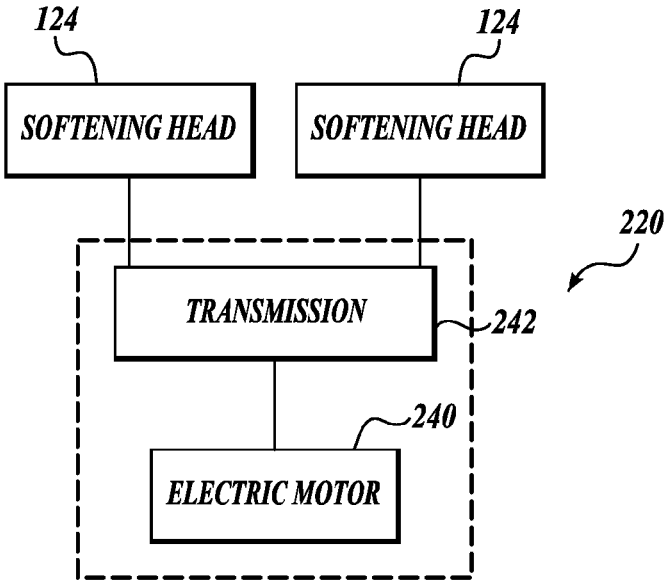
FIG. 7 illustrates in block diagrammatic form another example of the grooming device of FIG. 5.

In some embodiments, the grooming device 220 may include two electric motors 240 for driving the respective hair softening heads 124, as shown in FIG. 6. Alternatively, the grooming device 220 may include one electric motor 240 connected to a conventionally configured transmission 242, such as a gear, belt, or friction-type arrangement, that drives both the hair softening heads in a counter-rotating manner as indicated by the arrows in FIG. 8.

Figure 9:
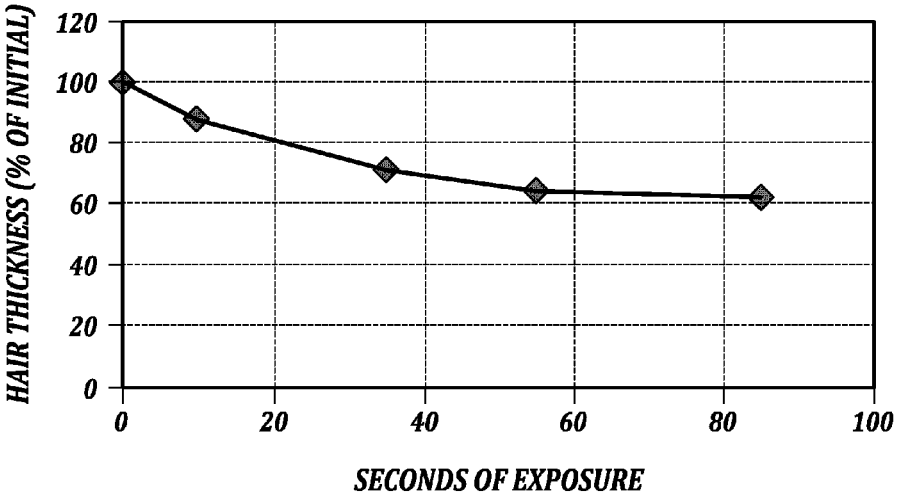
FIG. 9 illustrates in chart form percentage (%) reduction in hair thickness over time.

In these embodiments and others, abrasion by the abrasive pads 150 reduces the diameter of the hair follicle tips to about 60% of its initial diameter within a reasonable amount of time (e.g., about 1-2 minutes), as shown in FIG. 9. In some embodiments, the hairs can be tapered with the taper extending approximately 2-4 mm from the hair tips. In some embodiments, the electric motor or motors can drive the heads 124 at lower speeds than some of the examples set forth above. For example, the heads 124 can be driven with rotational speeds of 1000 rpms or greater.

Figure 8:
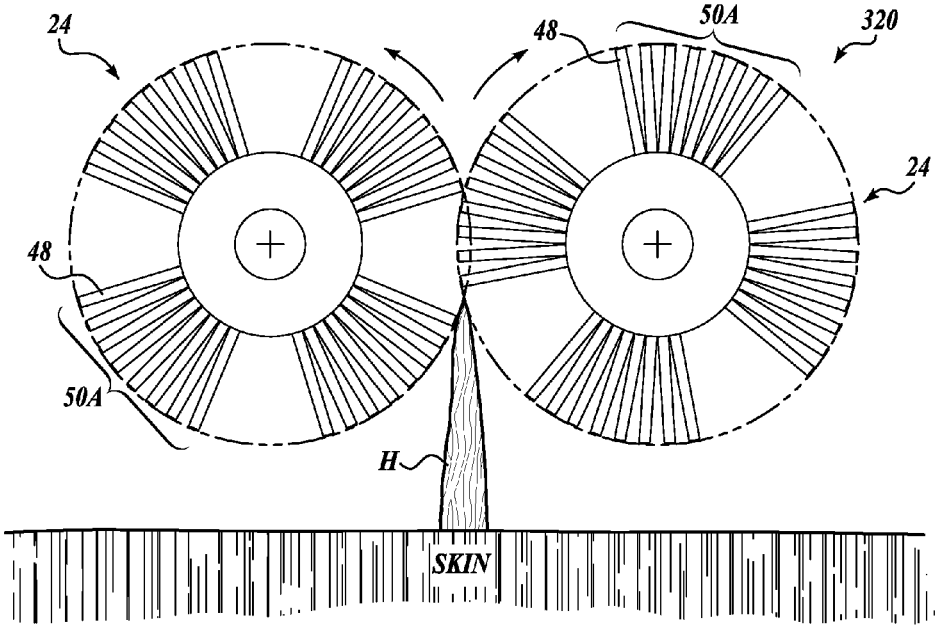
FIG. 8 is a top view of another example of a grooming device formed in accordance with aspects of the present disclosure.

FIG. 8 is a schematic representation of another embodiment of a grooming device 320 in accordance with aspects of the present disclosure. The device 320 is substantially similar in construction and operation as the grooming device 220 except for the differences that will now be described in more detail. As shown in FIG. 8, instead of the two hair softening heads 124, the grooming device 320 employs the hair softening heads 24 described with regard to FIGS. 1 and 3. In this embodiment, the hair softening heads 24 are parallely arranged such that the bristles 48 are generally co-planer. Further, the centers of rotation of the heads 24 are spaced apart a selected distance such that the bristle tips slightly overlap. As a result, when a hair follicle H enters an overlapping area of the counter-rotating bristle groups 50 of the two counter-rotating heads 24, the hair follicle H is compressed or crushed, resulting in a splitting of the ends thereof.

The above-described examples of the grooming devices 220 and 320 can be used to soften the hairs of a subject's face. In that regard, either grooming device 220 or 320 is turned on and motion is imparted to the two counter-rotating heads 124 or 24. In some embodiments, the hair softening heads can be rotated from about 1,000 rpms to about 20,000 or greater. As a result, the tips of the bristles 48 of heads 24 or the edges of abrasion pad 150 of heads 124 travel at speeds of between 3 mph (4.8 kilometers per hour) and 60 mph (97 kilometers per hour). In other embodiments, lower speeds may be employed.

Once rotating, the grooming device 220 or 320 is applied to the subject such that the hairs of the subject are transversely impacted by the respective counter-rotating heads. As a result, the hairs are either abraded by the abrasive pads 150 of heads 124 or crushed or compressed by the bristles 48 of the heads 24. Abrasion of the hairs causes a thinning or tapering of the ends of the hairs, resulting in a softer feeling beard. Crushing or compressing the hairs causes a splitting of the ends of the hairs. In some embodiments, the hairs are both trimmed and split. Once the areas of the beard are softened, the grooming devices 220 or 320 can be removed from the beard and can be powered down.

Thus, using examples of the grooming devices 220 and 320 as described above, in the representative process outlined above, results in a beard with a softer feel. The method described above can be carried-out without an attempt to soften the beard by the use of fluids, formulas, etc. However, any preparation of the beard prior to mechanical softening can be used as part of the method disclosed above.

It should be noted that for purposes of this disclosure, terminology such as "upper," "lower," "vertical," "horizontal," "fore," "aft," "inner," "outer," "inwardly," "outwardly," "front," "rear," "proximal," "distal," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A personal grooming device, comprising:

an appliance including a rotary drive system;

at least one hair softening head coupled to the appliance via a shaft so as to be rotated by the rotary drive system about an axis substantially parallel to an axis of the shaft, wherein the hair softening head includes a plurality of spaced-apart, radially-extending bristle groups, and wherein tips of the plurality of spaced-apart, radially-extending bristle groups are configured to split the tips of the subject's hair from about 1-4 millimeters from ends of the tips of the subject's hair when rotationally applied to the subject's hair.

2. The grooming device of claim 1, wherein the tips of the bristle groups are applied at a speed above 30 mph (48 kilometers per hour).

3. The grooming device of claim 1, further comprising a grooming guard attached to the appliance and positioned adjacent the at least one hair softening head, wherein the grooming guard includes at least one slot arranged generally co-planar with the plurality of spaced-apart, radially-extending bristle groups.

4. The grooming device of claim 1, wherein bristles of the plurality of spaced-apart, radially-extending bristle groups include a material selected from a group consisting of stainless steel, nylon, nylon silicon-carbide, and aluminum oxide.

5. The grooming device of claim 1, further comprising a guard attached to the appliance and positioned adjacent the at least one hair softening head, wherein the guard is structurally configured to align the tips of a subject's hair for treatment by the hair softening head.

6. The grooming device of claim 5, wherein the guard includes at least one slot configured to align the tips of a subject's hair for treatment by the hair softening head.

7. A grooming device, comprising first and second parallely oriented, counter-rotating treatment heads, wherein the tops of the treatment heads are substantially co-planer; and a drive system coupled to the first and second rotary heads via at least one shaft, the drive system configured to impart counter-rotational movement to the first and second heads via at least one shaft such that the first and second heads rotate about axes substantially parallel to an axis of the shaft, wherein tips of radially-extending bristles are configured to split the tips of a subject's hair from about 1-4 millimeters from ends of the tips of the subject's hair when rotationally applied to the subject's hair.

8. The grooming device of claim 7, wherein each treatment head includes a plurality of spaced-apart bristle groups, each bristle group comprising a plurality of bristles.

9. The grooming device of claim 8, wherein at least a portion of the tips of the bristles of the first and second treatment heads overlap when rotated by the drive system.

10. The grooming device of claim 7, wherein the drive system includes first and second electric motors configured to drive the first and second parallely oriented, counter-rotating treatment heads.

11. The grooming device of claim 7, wherein the drive system includes an electric motor and a transmission configured to drive the first and second parallely oriented, counter-rotating treatment heads.

12. A method for softening a subject's hair with a personal grooming device, the device having a rotary drive system and at least one hair softening head coupled thereto via a shaft so as to be rotated by the rotary drive system about an axis substantially parallel to an axis of the shaft, the at least one hair softening head having at least one contact surface that includes tips of radially-extending bristle groups, the method comprising:

rotating the at least one hair softening head; and applying the at least one rotating hair softening head against the facial hair of the subject in order for the at least one contact surface to impact the facial hair of the subject such that the tips of the radially-extending bristle groups split the tips of the subject's facial hair from about 1-4 millimeters from ends of the tips of the subject's facial hair.

13. The method of claim 12, wherein the at least one hair softening head includes two hair softening heads, each having a contact surface, wherein the hair softening heads are parallely arranged such that the contact surfaces overlap and are counter rotated by the rotary drive system, wherein applying the rotating hair softening head further includes causing the hair to enter the overlapping area and to be contacted thereby.

14. The method of claim 12, wherein rotating the hair softening head further includes rotating the contacting surface above 30 mph (48 kilometers per hour).

* * * * *